US009920777B2

(12) United States Patent
Brenneis et al.

(10) Patent No.: US 9,920,777 B2
(45) Date of Patent: Mar. 20, 2018

(54) DIFFERENTIAL CYLINDER FOR A HYDROMECHANICAL DRIVE FOR ELECTRICAL CIRCUIT BREAKERS

(71) Applicant: ABB Technology AG, Zürich (CH)

(72) Inventors: Thomas Brenneis, Mainaschaff (DE); Matthias Schmidt, Frankfurt (DE); Henrik Lohrberg, Frankfurt (DE); Frank Fiedler, Mannheim (DE); Bruno Gehlert, Hösbach (DE); Roland Palm, Florstadt (DE)

(73) Assignee: ABB Schweiz AG, Baden (CH)

( * ) Notice: Subject to any disclaimer, the term of this patent is extended or adjusted under 35 U.S.C. 154(b) by 394 days.

(21) Appl. No.: 14/171,462

(22) Filed: Feb. 3, 2014

(65) Prior Publication Data

US 2014/0137731 A1 May 22, 2014

Related U.S. Application Data

(63) Continuation of application No. PCT/EP2012/003167, filed on Jul. 26, 2012.

(30) Foreign Application Priority Data

Aug. 3, 2011 (DE) ..... 10 2011 109 210

(51) Int. Cl.
*F15B 15/22* (2006.01)
*H01H 3/60* (2006.01)
*H01H 33/34* (2006.01)

(52) U.S. Cl.
CPC ..... *F15B 15/22* (2013.01); *H01H 3/605* (2013.01); *H01H 33/34* (2013.01)

(58) Field of Classification Search
CPC .... F15B 15/204; F15B 15/222; F15B 15/224; F15B 15/227

(Continued)

(56) References Cited

U.S. PATENT DOCUMENTS 3,442,179 A * 5/1969 Comer ..... F15B 15/227 91/420
3,559,531 A * 2/1971 Leibfritz ..... F15B 15/223 137/454.5
3,608,437 A * 9/1971 Little et al. ..... F15B 15/222 91/407

(Continued)

FOREIGN PATENT DOCUMENTS

CN 102042280 A * 5/2011 ..... F15B 15/222
DE 19 25 166 A1 11/1970

(Continued)

OTHER PUBLICATIONS

International Search Report (PCT/ISA/210) dated Nov. 22, 2012, by the European Patent Office as the International Searching Authority for International Application No. PCT/EP2012/003167.
International Search Report (PCT/ISA/210) dated Nov. 22, 2012, by the European Patent Office as the International Searching Authority for International Application No. PCT/EP2012/003168.

*Primary Examiner* — Michael Leslie
*Assistant Examiner* — Matthew Wiblin
(74) *Attorney, Agent, or Firm* — Barnes & Thornburg LLP

(57) ABSTRACT

A differential cylinder for a hydromechanical drive for actuating an electrical switch, for example a high-voltage switch, is disclosed which includes a first pressure region for applying a working pressure, a second pressure region, and a piston which is capable of moving in a movement region and which is movable depending on a pressure difference between the first and second pressure region. A damping device is provided which, in the event of a movement of the piston in the direction of the second pressure region, provides damping with respect to the movement of the piston in a section of the movement region, wherein the damping is adjustable.

21 Claims, 7 Drawing Sheets

(58) Field of Classification Search
USPC ..... 91/396, 405, 407
See application file for complete search history.

(56) References Cited

U.S. PATENT DOCUMENTS

| | | | | | |
|---|---|---|---|---|---|
| 3,885,454 | A * | 5/1975 | Grieger | H01H 3/605 200/82 B |
| 4,807,514 | A | 2/1989 | Gratzmuller | |
| 4,862,786 | A * | 9/1989 | Boyer | F15B 15/22 277/560 |
| 5,309,817 | A * | 5/1994 | Sims | F15B 15/227 92/85 A |
| 6,038,956 | A * | 3/2000 | Lane | F15B 15/222 91/409 |
| 6,776,356 | B2 * | 8/2004 | Maliteare | A01M 7/0075 239/163 |
| 2009/0020508 | A1 | 1/2009 | Lohrberg et al. | |

FOREIGN PATENT DOCUMENTS

| | | | | |
|---|---|---|---|---|
| DE | 1925166 | A1 * | 11/1970 | F15B 15/224 |
| DE | 28 38 219 | A1 | 3/1980 | |
| DE | 31 23 169 | A1 | 12/1982 | |
| DE | 4401871 | A1 * | 7/1995 | F15B 15/222 |
| DE | 44 04 834 | A1 | 8/1995 | |
| DE | 4413512 | A1 * | 10/1995 | F15B 15/082 |
| DE | 10 2008 004063 | A1 | 7/2009 | |
| DE | 102009014817 | A1 * | 9/2010 | F15B 15/1433 |
| DE | 10 2009 015 881 | A1 | 10/2010 | |
| EP | 1847720 | A1 * | 10/2007 | F15B 11/044 |
| EP | 1988296 | A1 * | 11/2008 | F15B 15/224 |
| FR | 1439247 | A * | 5/1966 | F15B 15/227 |
| WO | WO 2009/086906 | A1 | 7/2009 | |
| WO | WO 2009086906 | A1 * | 7/2009 | H01H 33/34 |
| WO | WO 2010/112130 | A1 | 10/2010 | |

* cited by examiner

DIFFERENTIAL CYLINDER FOR A HYDROMECHANICAL DRIVE FOR ELECTRICAL CIRCUIT BREAKERS

RELATED APPLICATION(S)

This application claims priority as a continuation application under 35 U.S.C. § 120 to PCT/EP2012/003167, which was filed as an International Application on Jul. 26, 2012 designating the U.S., and which claims priority to German Application 10 2011 109210.6 filed in Germany on Aug. 3, 2011. The entire contents of these applications are hereby incorporated by reference in their entireties.

FIELD

The disclosure relates to hydraulic differential cylinders for hydromechanical drives for electrical circuit breakers.

BACKGROUND INFORMATION

Hydromechanical stored-energy spring mechanisms can have differential cylinders. A piston of the differential cylinder is connected to a piston rod, which can be moved by pressurization of a pressure volume. The piston rod can be connected to an electrical circuit breaker, thus enabling the electrical circuit breaker to be switched by moving the piston rod. To open the electrical circuit breaker, for example, the pressure volume of the differential cylinder can be subjected to a hydraulic pressure, moving the piston rod into a corresponding position.

The pressure in the pressure volume can be supplied by a pressure cylinder, which can be coupled to a mechanical energy storage device, for example, a spring arrangement. If the circuit breaker is to be switched, the spring force on the pressure cylinder is released, with the result that a working pressure builds up there. This is also present via a hydraulic connection in the pressure volume of the differential cylinder. The working pressure in the pressure region can move the piston and the piston rod of the differential cylinder.

If the mechanical energy storage device on the pressure cylinder is designed as a spring arrangement, it can be subjected to a preload in order to provide a sufficient force. When the spring arrangement is triggered, the working pressure can build up very quickly, and therefore the pressure region of the differential cylinder can be subjected almost immediately to the working pressure. As a result, the piston of the differential cylinder can be moved in the direction of an end stop with a high acceleration force. To protect the differential cylinder and the other mechanical components coupled thereto, end position damping can be provided, in which the speed of the piston can be reduced before it or some other component strikes a stop. Damping is intended to ensure that the final speed of the piston upon impact is brought below a predetermined threshold in order to avoid damage to the components.

Depending on the application and on the type of circuit breaker to be switched, on the trigger speed, the working pressure provided and the like, a specific geometrical design of the damping can be devised for each individual application. As a result, the hydromechanical stored-energy spring mechanisms can already be tied to a particular use at the beginning of manufacture. It can be difficult to change the area of application after their production. This makes the production of hydromechanical stored-energy spring mechanisms inflexible because they may only be produced specifically for a particular application and it may not be possible to produce them as reserve stock for a number of undefined uses and to adapt them to the given application after their production.

It is therefore desirable to provide a hydromechanical stored-energy spring mechanism which has end position damping that enables retardation in such a way that a final speed of the piston rod below a predetermined threshold is achieved before the piston, the piston rod or a component connected thereto strikes an end stop, irrespective of the working pressure supplied by the mechanical energy storage device and irrespective of the mass moved by the piston rod.

SUMMARY

A differential cylinder for a hydromechanical drive is disclosed for actuating an electrical switch, comprising a first pressure region for supplying with a working pressure, a second pressure region, a piston, having a range of movement and which is movable depending on a pressure difference between the first and second pressure regions, and a damping device provided which, in an event of a movement of the piston in a direction of the second pressure region, provides damping with respect to the movement of the piston in a section of the range of movement, wherein the damping is adjustable.

A hydromechanical drive for a high-voltage circuit breaker is disclosed having a differential cylinder comprising a first pressure region for supplying with a working pressure, a second pressure region, a piston, having a range of movement and which is movable depending on a pressure difference between the first and second pressure regions, and a damping device provided which, in the event of a movement of the piston in a direction of the second pressure region, provides damping with respect to the movement of the piston in a section of the range of movement, wherein the damping is adjustable.

BRIEF DESCRIPTION OF THE DRAWINGS

Exemplary embodiments of the present disclosure are explained in greater detail below with reference to the attached drawings, in which.

DETAILED DESCRIPTION

Figure 1:
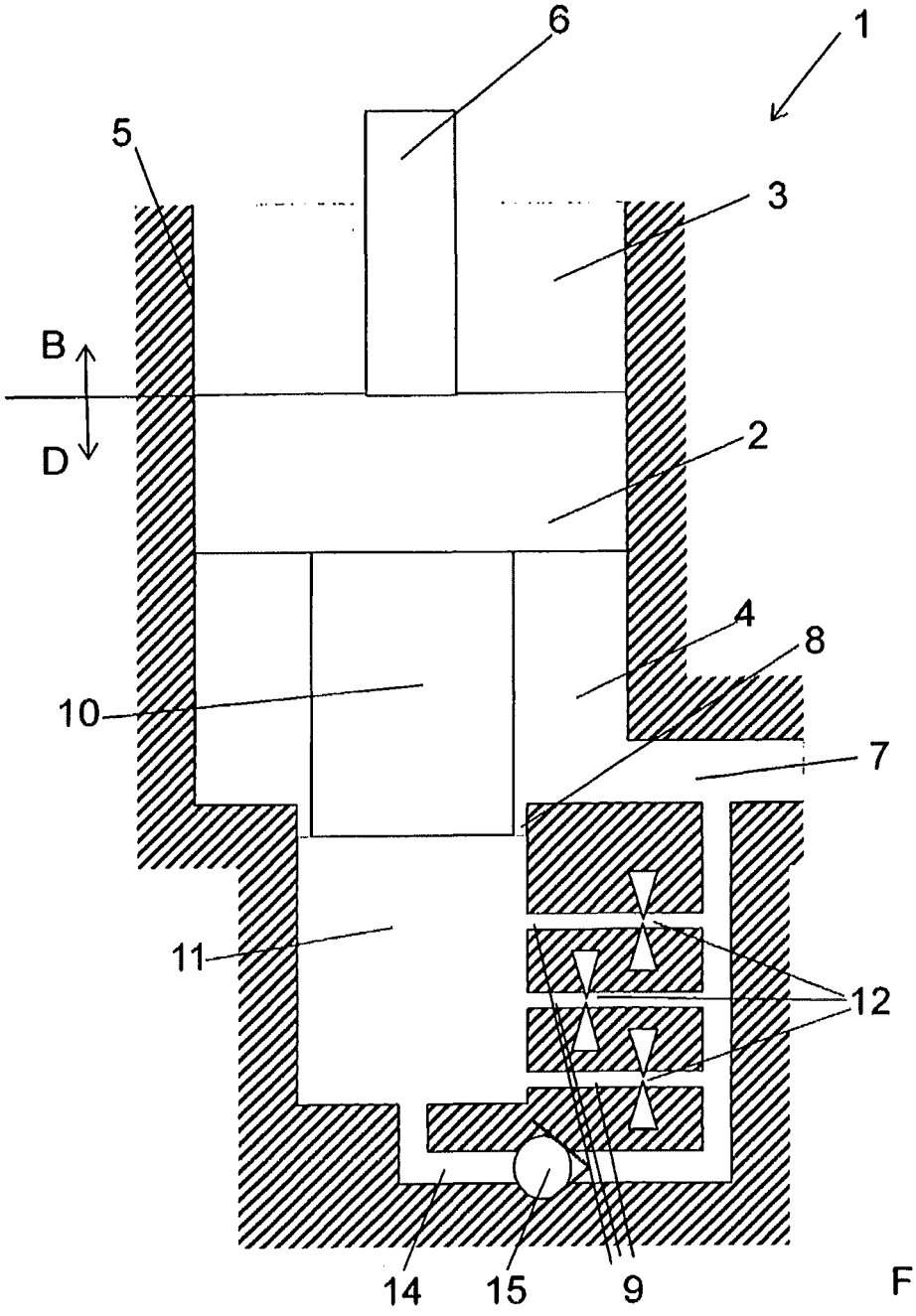
FIG. 1 shows a schematic cross-sectional view through a hydraulic differential cylinder having end position damping in accordance with a first exemplary embodiment of the disclosure.

Exemplary embodiments of the present disclosure are directed to a hydromechanical drive for actuating an electrical circuit breaker in which the level of end position damping can be adjusted individually on the fully assembled drive or in which the level of end position damping is self-regulated.

According to an exemplary embodiment of the disclosure, a differential cylinder for a hydromechanical drive for actuating an electrical switch, for example a high-voltage switch, is provided. The differential cylinder includes a first pressure region for supplying with a working pressure, a second pressure region, a piston, which is capable of moving in a range of movement and which is movable depending on a pressure difference between the first and second pressure regions. A damping device is provided which, in the event of a movement of the piston in the direction of the second pressure region, can provide damping with respect to the movement of the piston in a section of the range of movement. The damping is adjustable.

Exemplary embodiments of the differential cylinder for a hydromechanical drive provide damping of a movement of the piston in a section (partial range) of the range of movement of the piston in order to reduce the speed of the piston before it reaches an end stop. By providing adjustable damping, it is possible to design the differential cylinder independently of knowledge as to the subsequent system in which it is used. The damping can be set when the desired damping that the piston is to undergo before striking a stop is known.

In this way, very largely application-neutral manufacture of hydromechanical drives of this kind is possible without knowing the final use.

The damping device can furthermore have a damping chamber at an opposite end of the second pressure region from the piston and can have a damping pin projecting on the piston in the direction of the second pressure region. The damping pin and the damping chamber can be designed in such a way that the damping pin projects into the damping chamber in a section of the range of movement and thus can separate the second pressure region from the damping chamber.

It is thereby possible to provide that no significant damping is caused in a first section of the range of movement of the piston. Only in a second section of the range of movement, when the damping pin enters a damping chamber due to the movement of the piston, is the fluid situated in the damping chamber enclosed, with the result that it can flow out of the damping chamber only through a reduced passage cross section. As a result, there can be a significant increase in damping with respect to the movement of the piston in the first piston region. The cross section through which the hydraulic fluid can flow out of the damping chamber is adjustable, thus enabling the hydromechanical drive to be adjusted to the application, for example, to the initial speed of the piston, the force acting on the piston, the maximum speed of the piston and the mass of the elements connected to the piston rod, in order to achieve the desired switching behavior of the circuit breaker actuated by the hydromechanical drive.

Provision can be made for the damping pin and the damping chamber to be designed in such a way that, after the penetration of the damping pin into the damping chamber, there remains a residual gap, which has a predetermined passage cross section.

For example, the predetermined passage cross section can be chosen in such a way that it brings about a predetermined maximum damping with respect to the movement of the piston.

The damping chamber can have one or more outlet lines, which are each closed or opened by the damping pin depending on the position of the damping pin in the damping chamber. The outlet lines are connected by connecting lines to adjustable restrictor units in order to set a passage cross section for a hydraulic fluid situated in the damping chamber.

An adjusting unit can furthermore be provided in order to jointly set the passage cross sections of the restrictor units.

According to an exemplary embodiment of the disclosure, the damping chamber can be arranged in a mobile damping piston, which is capable of moving in the direction of a third pressure region, with the result that the damping piston moves in the direction of the third pressure region depending on a pressure in the damping chamber. This can limit a pressure rise in the damping chamber.

A pressure compensating line can be provided between the damping chamber or the damping pin and a volume connected to the second pressure region. A valve can be provided in the pressure compensating line to allow only inflow of hydraulic fluid into the damping chamber.

A connecting line can furthermore be provided between the damping chamber and a volume connected to the second pressure region. A valve can be provided in the connecting line, opening a passage cross section depending on a supplied working pressure and a pressure in the damping chamber in order to limit the pressure in the damping chamber. A further control surface can be provided in order to open the valve in the case of a positive pressure gradient between the volume connected to the second pressure region and the pressure in the damping chamber.

According to an exemplary embodiment of the disclosure, a hydromechanical drive having the above differential cylinder is provided.

FIG. 1 shows a schematic cross-sectional view of an exemplary embodiment of a hydraulic differential cylinder 1 according to the disclosure having a piston 2, which separates a first pressure region 3 from a second pressure region 4. The piston 2 is arranged movably in a cylinder interior 5. The piston 2 separates the first and the second pressure regions 3, 4 hermetically from one another. The first pressure region 3 can be supplied with a working pressure.

The working pressure can, for example, be supplied by a separate pressure cylinder and can be exerted on a piston of the pressure cylinder by the release of a mechanical energy storage device, for example, a preloaded diaphragm or helical spring.

The hydraulic differential cylinder 1 serves to provide a triggering movement. For this purpose, the piston 2 of the differential cylinder 1 is connected to a piston rod 6, which brings about opening and closure of an electrical circuit breaker directly or indirectly as an actuator.

When the working pressure is acting in the first pressure region 3, the piston 2 moves in accordance with the pressure difference between the first and the second pressure region 3, 4 in such a way that the volume of the second pressure region 4 decreases. The hydraulic fluid situated in the second pressure region 4 flows off via the hydraulic line 7 directly into a hydraulic fluid container and therefore does not exert significant counterpressure on the piston 2. When the hydromechanical drive is triggered, the piston 2 of the differential cylinder 1 is accelerated. The second pressure region 4 does not contribute to reducing the speed of the piston 2. In this way, a switching operation performed with the aid of the hydromechanical drive can be carried out at a desired speed, thus allowing rapid triggering operations.

The piston 2 of the differential cylinder 1 or a component connected thereto, which is accelerated by the triggering operation, should be prevented from striking an end stop without being retarded since the stop can be damaged as a result and, in addition, troublesome noise can arise. For this reason, end position damping is provided. In this exemplary embodiment, the end position damping is formed with the aid of a cylindrical, for example circular-cylindrical, damping pin 10. The damping pin 10 is passive during a movement of the piston 2 in a range B of movement in the interior 5 and brings about damping of the movement of the piston 2 as soon as the piston 2 is moving in a damping range D, as the volume of the second pressure region 4 is reduced further. The position which represents the transition between the range B of movement and the damping region D can be defined by the entry of the damping pin 10 into a likewise cylindrical damping chamber 11 as the volume of the second pressure region 4 is reduced.

In the exemplary embodiment shown in FIG. 1, the damping chamber 11 has a cross section which corresponds substantially to the cross section of the damping pin 10. Once the damping pin 10 enters the damping chamber 11, the damping pin 10 cuts off the hydraulic fluid situated in the damping chamber 11 hermetically, or to a very large extent hermetically, from the second pressure region 4. The hydraulic line 7 for carrying the hydraulic fluid out of the second pressure region 4 is thus no longer in direct fluid connection with the hydraulic fluid enclosed in the damping chamber 11. In an exemplary embodiment according to the disclosure, the cross section of the damping pin 10 can be made less than the cross section of the damping chamber 11 in order to ensure a residual gap 8 for the passage of hydraulic fluid. The effective passage cross section of the residual gap can be chosen so that damping of the movement of the piston 2 with a maximum damping that can be set is made possible. The maximum damping that can be set can be predetermined during the design of the hydraulic drive, for example. Thus, for example, a passage cross section of 0.5% to 5% of the cross-sectional area of the damping pin 10 is possible.

The damping chamber 11 has a number of outlet lines 9, which represent connecting lines between the damping chamber 11 and the hydraulic line 7. The outlet lines 9 each have a restrictor unit 12, which represents a flow resistance for the hydraulic fluid in the outlet lines 9. In an exemplary embodiment according to the disclosure, three outlet lines 9 having respective restrictor units 12 with separately variable cross sections can be provided. The outlet lines 9 are arranged on a side wall of the damping chamber 11 at axially mutually offset positions with respect to the direction of movement of the damping pin 10, with the result that one or more of the outlet lines 9 can be closed by the damping pin 10 (or by the side wall of the damping pin 10), depending on the position of the damping pin 10 in the damping chamber 11.

A check valve 15 is furthermore provided in another connecting line 14 between the second pressure region 4 or hydraulic line 7 and the damping chamber 11 to ensure that, during a movement of the piston 2 out of the damping region D, this movement is not damped as well but that this movement can be carried out with as little damping as possible. During a movement of the piston 2 in the direction of range B of movement, hydraulic fluid then also flows from the hydraulic fluid container via the hydraulic line 7, the further connecting line 14 and the check valve 15 into the damping chamber 11. To ensure that the outlet of the further connecting line 14 into the damping chamber 11 cannot be closed by the damping pin 10, thereby hindering the inflow of the hydraulic fluid, the outlet of the further connecting line 14 is arranged at an end of the damping chamber 11 which lies opposite the opening for the damping pin 10.

The restrictor units 12 have a variable cross section which can be set individually. The respective connecting lines 9 which connect the damping chamber 11 to the second pressure region 4 via the respective restrictor unit 12 are arranged at different axial positions with respect to the direction of movement of the damping pin 10. In this way, increasing damping can be achieved, the further the damping pin 10 penetrates into the damping chamber 11. While the cross sections of the restrictor units 12 in total, initially permit the outflow of the hydraulic fluid enclosed in the damping chamber 11 in the damping region, access to the first connecting line 9 and the corresponding restrictor unit 12 is first of all closed as the damping pin 10 moves further. This results in that only the cross sections of the second and third restrictor units 12 can provide for the outflow of the hydraulic fluid from the damping chamber 11. In the case of further movement of the damping pin 10 into the damping chamber 11, access to the second connecting line 9 is then also closed, with a corresponding increase in damping because only the cross section of the third restrictor unit serves as a remaining cross section for the outflow of the hydraulic fluid. The stepwise reduction in cross section through which the hydraulic fluid can flow out of the damping chamber 11 brings about a stepwise increase in the damping acting on the piston 2 and leads to increasing retardation of the movement of the piston 2. For this purpose, the restrictor units 12 can be set in such a way that the damping pressure in damping region D does not exceed a permissible maximum.

The check valve 15 remains closed during the retardation of the movement, i.e. during a movement of the piston 2 in the direction of the damping region D, and serves merely to prevent the movement of the piston 2 in the opposite direction, i.e. in the direction of range B of movement, from being hindered by the damping.

Because the speed and mass which is moved with the piston 2 are variable, the damping pressure and final speed with a fixed, invariable, geometry of the connection between the damping chamber 11 and the hydraulic fluid container would differ so greatly that they would be uncontrollable. The provision of restrictor units 12 with a variable cross-sectional geometry thus makes it possible to adjust the damping and also the damping characteristic individually, independently and in an infinitely variable manner, thus enabling the differential cylinders to be manufactured independently of the application.

Figure 2:
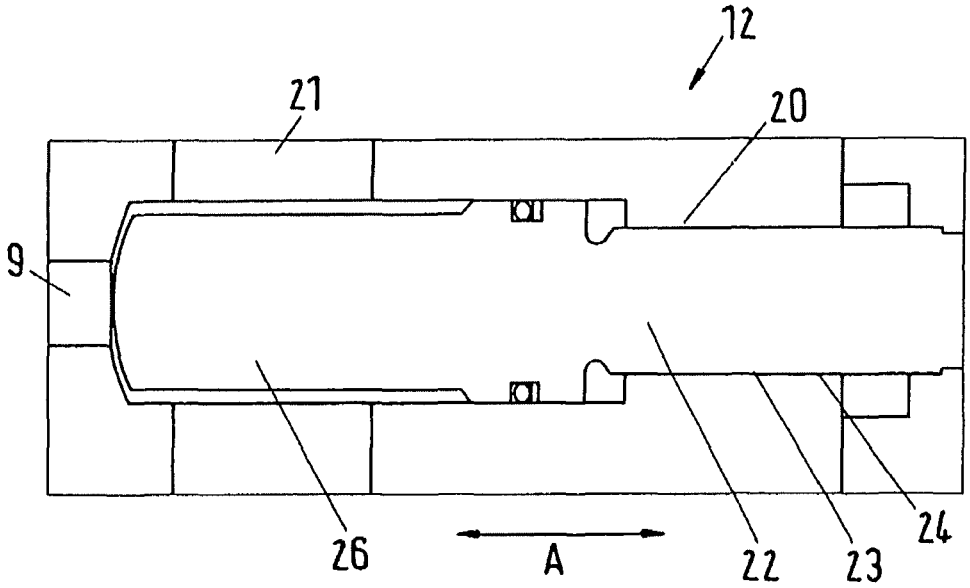
FIG. 2 shows a schematic cross-sectional view of a damping restrictor, which is shown in the hydraulic differential cylinder of FIG. 1.

FIG. 2 shows an exemplary embodiment according to the disclosure of a restrictor unit 12 with an individually adjustable effective cross-sectional area. A restrictor sleeve 20, which can be connected to the damping chamber 11 at one end via the outlet line 9, can be seen. A connection line 21, which can be connected to the hydraulic line 7 or corresponds to the latter, is provided transversely to the axial direction of the sleeve 20. An adjusting screw 22 is introduced into the interior of the sleeve 20. The adjusting screw 22 has a head part 26, which can be moved in the axial direction A of the restrictor sleeve 20 in order to increase or reduce the size of a passage between the outlet line 9 and the connection line 21. The effective passage cross section can be adjusted by positioning the adjusting screw 22.

The adjusting screw is provided on a head part 26 with an external thread 23. The external thread 23 is in engagement with an internal thread 24, which is arranged on the sleeve 20 in a region situated opposite the external thread 23. By the threads, the adjusting screw 22 can be adjusted by being turned in the axial direction A, allowing precise setting of the effective passage cross section of the restrictor unit 12.

Figure 3:
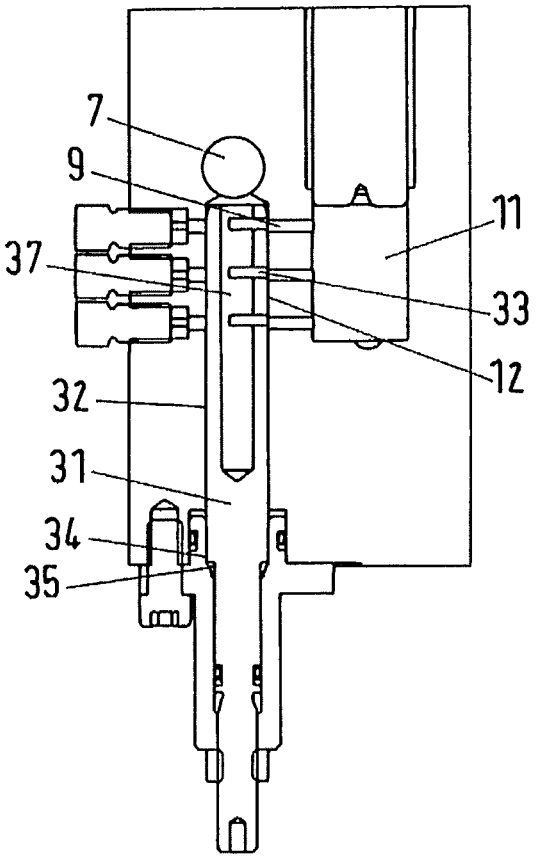
FIG. 3 shows a schematic cross-sectional view of a hydraulic differential cylinder in accordance with an exemplary embodiment of the disclosure.
Figure 4:
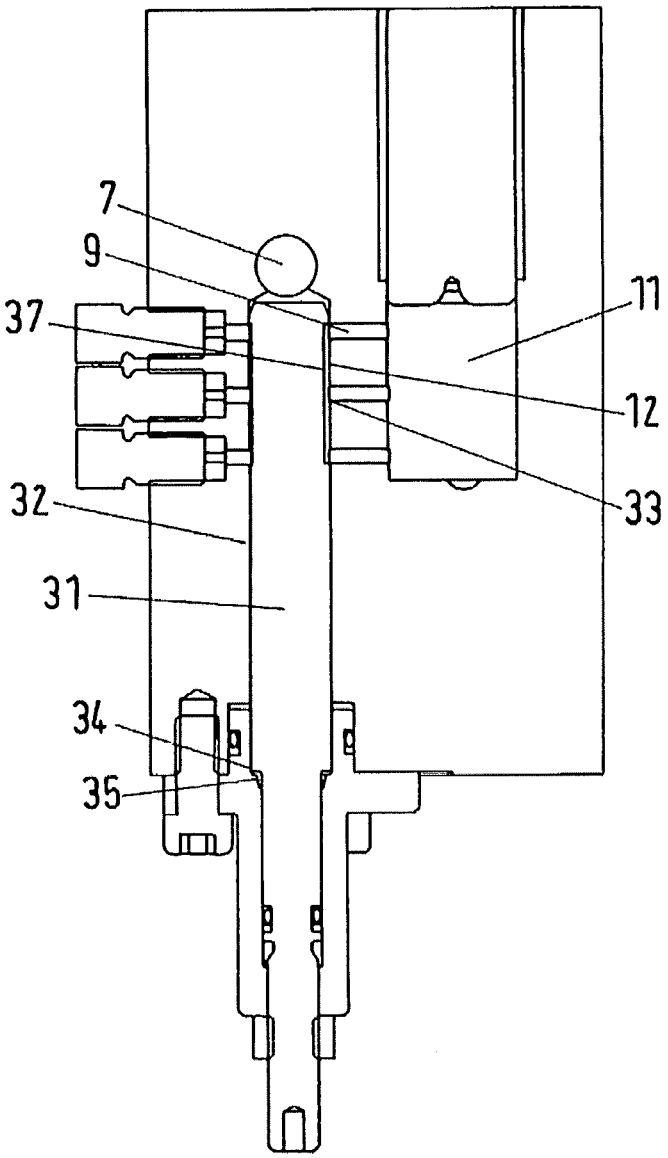
FIG. 4 shows a schematic cross-sectional view of a hydraulic differential cylinder in accordance with an exemplary embodiment of the disclosure.
Figure 5:
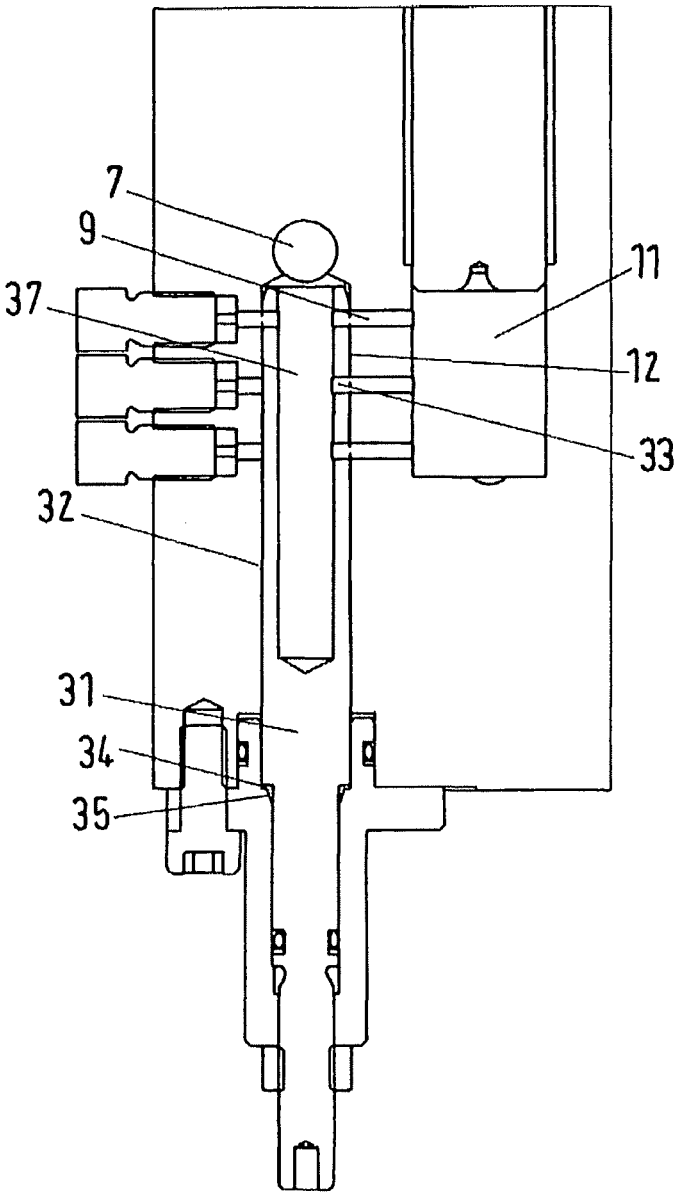
FIG. 5 shows a schematic cross-sectional view of a hydraulic differential cylinder in accordance with an exemplary embodiment of the disclosure.

Exemplary embodiments according to the disclosure are shown in FIGS. 3, 4 and 5, in which embodiments the outlet lines 9 of the damping chamber 11 are provided with corresponding restrictor units 12. The passage cross sections of the restrictor units 12 are set jointly. For this purpose, an adjusting element 31 is provided in a sleeve-shaped recess 32, wherein the adjusting element 31 is held rotatably, and therefore cannot move in the axial direction of the sleeve-shaped recess 32. This can be achieved, for example, by a circumferentially formed step 34, which is held by a corresponding step 35 in the sleeve-shaped recess 32, which serves as a stop.

The connecting lines of the outlet lines 9 open into a circumferential surface of the sleeve-shaped recess 32. A port leading to the hydraulic line 7 or the hydraulic fluid container is provided at a front end of the sleeve-shaped recess 32.

The adjusting element 31 has a cavity 37. Passages 33 in the circumferential surface of the adjusting element 31 connect the outer surface to the cavity 37 or free space 37. The cavity 37 or free space 37 opens at an end of the adjusting element 31 which is associated with the front end of the sleeve-shaped recess 32, the end provided with the port leading to the hydraulic line 7. The passages 33 can be of slot-shaped or circular design or can be designed as eccentrics, with a cross section that varies in the axial or radial direction of extent of the adjusting element 31. The passages 33 are arranged at positions which correspond to the positions of the mouths of the outlet lines 9, with the result that the passages 33 come into partial or full overlap with the mouths of the outlet lines 9 through appropriate rotation of the adjusting element 31. The degree of overlap between the mouths of the outlet lines 9 and the passages 33 defines the effective passage cross section of the restrictor unit thus formed.

Figure 6:
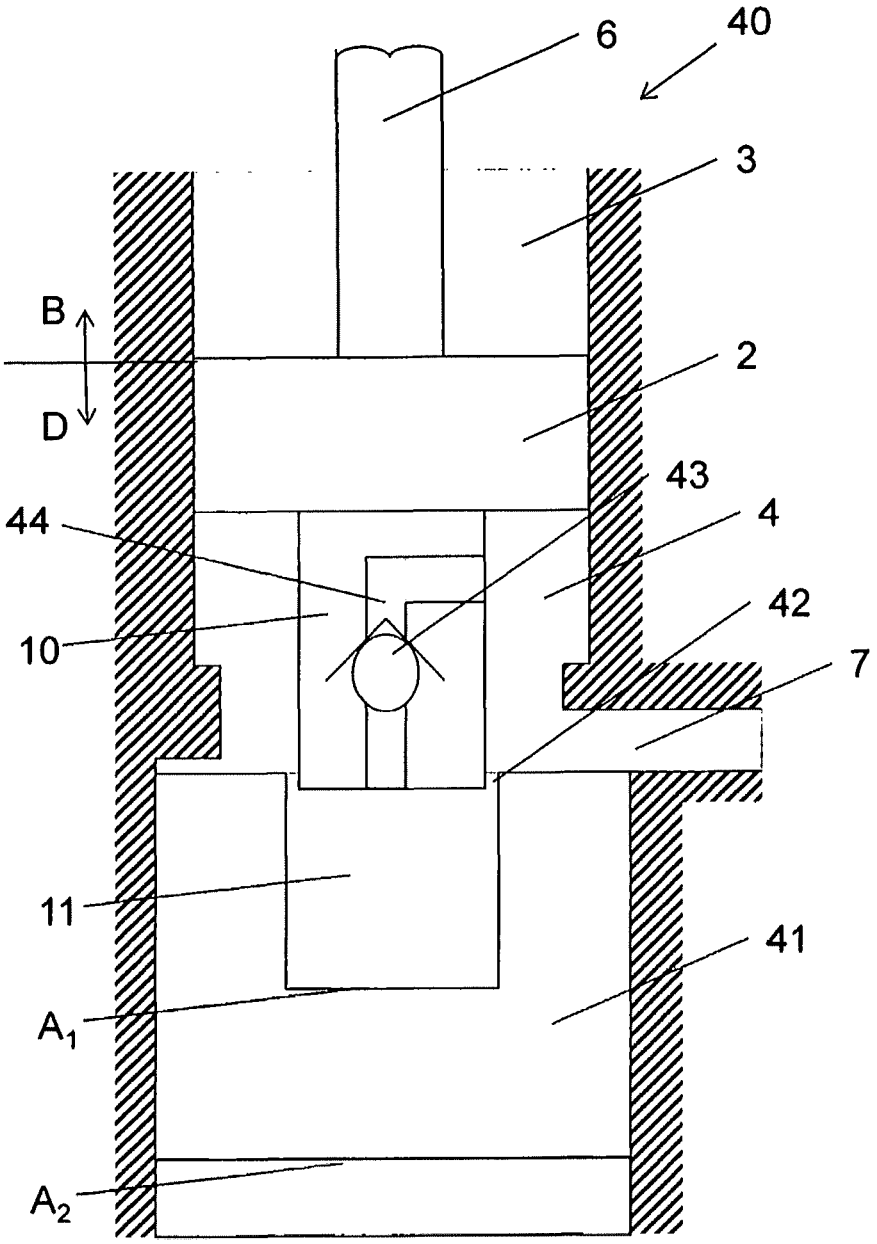
FIG. 6 shows a schematic cross-sectional view of a hydraulic differential cylinder in accordance with an exemplary embodiment of the disclosure.

FIG. 6 shows a schematic cross-sectional view of another exemplary embodiment of a hydraulic differential cylinder 40 with end position damping according to the disclosure. One difference between the hydraulic differential cylinder of FIG. 1 and the hydraulic differential cylinder of FIG. 6 is that the damping chamber 11 is arranged in a movable damping piston 41. The damping piston 41 can be moved in the same direction as piston 2 and can be subjected to the working pressure or some other adjustable pressure on a side (third pressure region) opposite the damping chamber 11.

As in FIG. 1, the damping pin 10 and the damping chamber 11 have cross sections which leave a residual gap 42 when the damping pin 10 penetrates into the damping chamber 11, through which gap hydraulic fluid can emerge from the damping chamber 11 into the second pressure region 4. In this way, a restrictor effect is provided by the residual gap 42 because the hydraulic fluid enclosed in the damping chamber 11 can pass via the second pressure region 4 into the hydraulic fluid container.

In contrast to the embodiment in FIG. 1, the damping chamber 11 in the damping piston 41 is not connected to the hydraulic fluid container via one or more restrictor units 12.

During the movement of piston 2 into the damping region D, the unhindered discharge of hydraulic fluid in the damping chamber 11 to the hydraulic fluid container is interrupted, and a high damping pressure arises in the damping chamber 11. The damping pressure acts on a first control surface $A_1$, which corresponds substantially to the cross-sectional area of the damping chamber 11. The damping pressure exerts a force on the damping piston 41. As soon as the force on the first control surface $A_1$ in the damping chamber 11 is greater than the force exerted by the working pressure via a further piston surface $A_2$ of the damping piston 41, the surface lying opposite the damping chamber 11, the damping piston 41 is moved in the damping direction, i.e. in the same direction in which the damping pin 10 is moving. As a result, the rise in the damping pressure in the damping chamber 11 can be reduced. As soon as piston 2 has reached its end position and the retardation process of the differential piston 2 is concluded, the damping pressure in the damping chamber 11 falls again due to an outflow of the hydraulic fluid through the residual gap 42, and the damping piston 41 is pushed back into its initial position by the working pressure on the second piston surface $A_2$. The damping of piston 2 in the damping region can be set by the pressure in the third pressure region or the size of a second control surface $A_2$.

A check valve 43 can be provided in a bypass line 44 in the interior of the damping pin 10, by which valve an opening to the damping chamber 11 is connected to an opening in the side wall of the damping pin 10. A fluid connection between the damping chamber 11 and the second pressure region 4 is thereby provided, even when the damping pin 10 is in the damping chamber 11. The check valve 43 is provided in such a way that it opens during a movement of piston 2 in a direction of movement out of the damping region D, i.e. in the case of a positive pressure gradient between the second pressure region 4 and the damping chamber 11. This embodiment can allow unhindered movement of piston 2 in direction B of movement.

Figure 7:
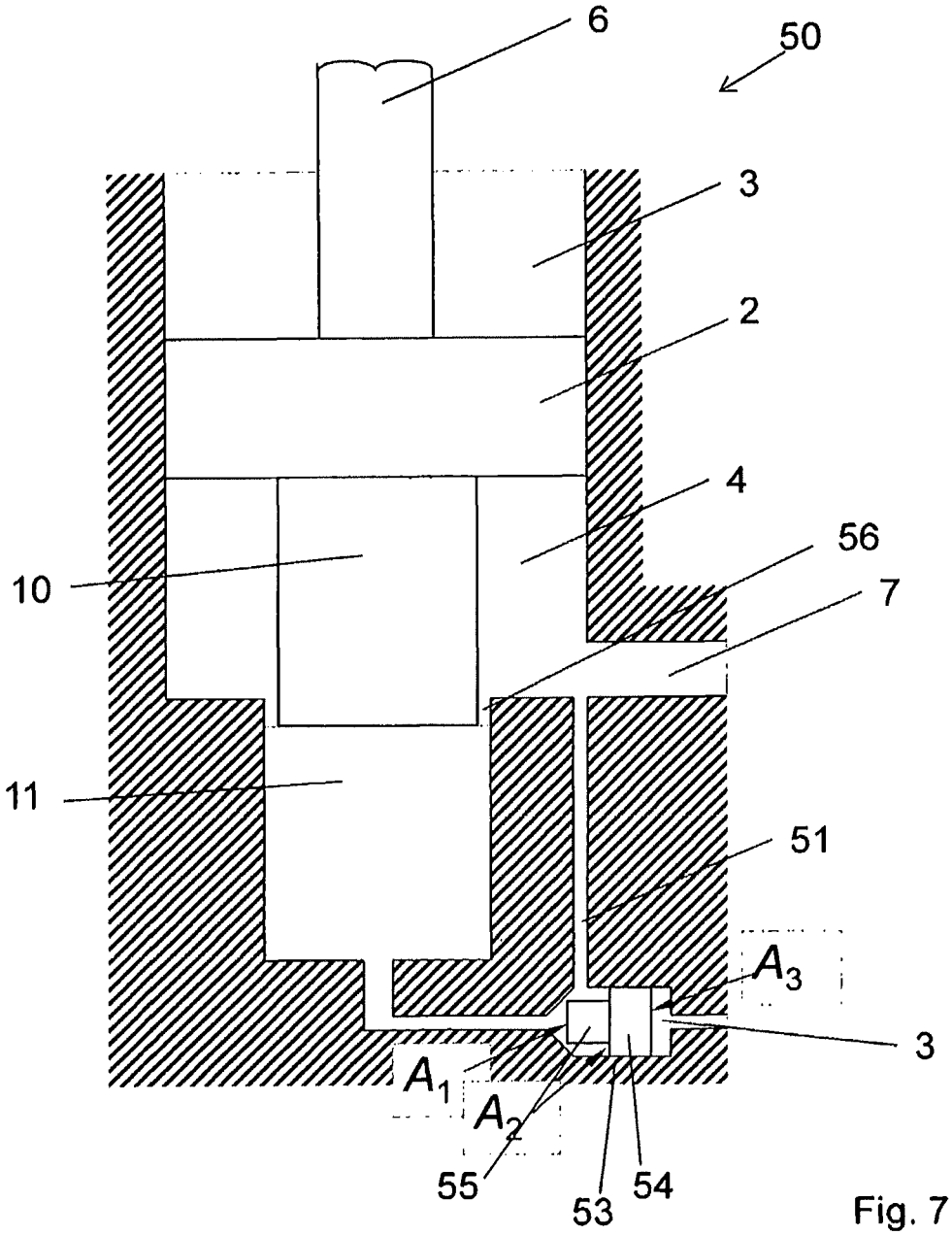
FIG. 7 shows a schematic cross-sectional view of a hydraulic differential cylinder in accordance with an exemplary embodiment of the disclosure.

FIG. 7 shows a schematic cross-sectional view of another exemplary embodiment of a hydraulic differential cylinder 50 in accordance with another embodiment of the disclosure. As in the illustrative embodiment in FIG. 1, the damping chamber 11 is connected to the hydraulic line 7, which connects the second pressure region 4 to the hydraulic fluid container, or directly to the second pressure region 4 via a connecting line 51. A control cylinder 53 having a control piston 54 is provided in the connecting line 51. The control piston 54 serves to create a connection between the damping chamber 11 and the second pressure region 4 or hydraulic fluid container. The control piston 54 is designed as a differential piston, one side of which has a piston surface $A_3$ which is exposed to the working pressure, to which piston 2 is also subjected on the same side as the first pressure region 3, while the corresponding other side has a control surface $A_1$ of comparatively smaller size on a control pin 55 provided on the control piston, the surface being exposed to the pressure of the damping chamber 11. The control pin 55 furthermore serves to form a valve for the connecting line 51. The passage cross section of the valve is given by the position of the control piston 54. Initially, the valve is closed owing to the working pressure acting on the piston surface $A_3$.

As in the embodiment in FIG. 6, a residual gap 56 is provided between the damping pin 10 and the damping chamber 11, allowing hydraulic fluid to emerge into the second pressure region 4 with a defined cross section. If the damping pressure in the damping chamber 11 rises, it depends on the design of the control piston 54 when the control piston 54 is moved and allows the additional discharge between the damping chamber 11 and the hydraulic fluid container via the connecting line 51. If the pressure in the damping chamber 11 falls, the working pressure acting on the further control surface $A_3$ of the control pin 55 moves the control piston 54 and brings about closure of the connecting line 51.

The opening pressure of the control piston 54 can be determined in a simple manner by the area ratio of the piston surface $A_3$ to the control surface $A_1$ ($P1=P3\times A_3/A_1$). The control piston 54 forms a self-regulating system which holds the pressure in the damping chamber 11 constant below a value set by the area ratio during the entire retardation process of piston 2.

The control piston 54 furthermore has a surface $A_2$, on which the pressure of the hydraulic fluid in the second pressure region 4 acts in the closed state of the control valve. If piston 2 is supposed to move in the opposite direction (through a reduction in the working pressure), the damping pressure in the damping chamber 11 is reduced, and a positive pressure gradient arises between the second pressure region 4 and the damping chamber 11. In this case, the control piston 54 opens the full cross section and allows a sufficiently large fluid flow from the hydraulic fluid line 7 into the damping chamber 11 to avoid hindering the movement of the damping pin 10 out of the damping chamber 11. In order to ensure such a functionality, provision is made for the sum of the first control surface $A_1$ and the second control surface $A_2$ to exceed the further piston surface $A_3$.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE SIGNS

1 differential cylinder
2 piston
3 first pressure region
4 second pressure region
5 cylinder interior
6 piston rod
7 hydraulic line
8 residual gap
9 outlet line
10 damping pin
11 damping chamber
12 restrictor unit
14 further connecting line
15 check valve
20 sleeve
21 connection line
22 adjusting screw
23 external thread
24 internal thread
26 head part
31 adjusting element
32 recess
33 passage
34 step
35 step
37 cavity, free space
40 differential cylinder
41 damping piston
42 residual gap
43 check valve
44 bypass line
50 differential cylinder
51 connecting line
53 control cylinder
54 control piston
55 control pin
56 residual gap
$A_1$ first control surface
$A_2$ second control surface
$A_3$ further control surface

What is claimed is:

1. A differential cylinder for a hydromechanical drive for actuating an electrical switch, comprising:

a first pressure region for supplying with a working pressure;

a second pressure region;

a piston, having a range of movement and which is movable depending on a pressure difference between the first and second pressure regions; and a damping chamber at an end of the second pressure region opposite from the piston, the damping chamber including a plurality of outlet lines, which are each closed or opened by a damping pin depending on a position of the damping pin in the damping chamber, the damping pin having a cross-section different than a cross-section of the piston; and a plurality of adjustable restrictor units, wherein the outlet lines are each connected to a respective adjustable restrictor unit for setting a passage cross section for a hydraulic fluid situated in the damping chamber and wherein each of the plurality of adjustable restrictor units is individually adjustable;

wherein in an event of a movement of the piston in a direction of the second pressure region, the plurality of adjustable restrictor units provide damping with respect to the movement of the piston in a section of the range of movement, wherein the damping is adjustable.

2. The differential cylinder as claimed in claim 1, wherein the damping pin projects from the piston in the direction of the second pressure region, wherein the damping pin and the damping chamber are arranged such that the damping pin projects into the damping chamber in a section of the range of movement for separating the second pressure region from the damping chamber.

3. The differential cylinder as claimed in claim 2, wherein the damping pin and the damping chamber are arranged such that, after penetration of the damping pin into the damping chamber, there remains a residual gap which has a predetermined passage cross section.

4. The differential cylinder as claimed in claim 3, wherein the predetermined passage cross section is arranged such that it brings about a predetermined maximum damping with respect to the movement of the piston.

5. The differential cylinder as claimed in claim 4, comprising:

a pressure compensating line provided between the damping chamber and a volume connected to the second pressure region; and a valve provided in the pressure compensating line to allow only inflow of hydraulic fluid Into the damping chamber.

6. The differential cylinder as claimed in claim 4, comprising:

a connecting line provided between the damping chamber and a volume connected to the second pressure region;

a valve provided in the connecting line, opening a passage cross section depending on a supplied working pressure and a pressure in the damping chamber in order to limit the pressure in the damping chamber; and a control surface provided in order to open the valve in case of a positive pressure gradient between the volume connected to the second pressure region and a pressure in the damping chamber.

7. The differential cylinder as claimed in claim 3, comprising:

a pressure compensating line provided between the damping chamber and a volume connected to the second pressure region; and a valve provided in the pressure compensating line to allow only inflow of hydraulic fluid into the damping chamber.

8. The differential cylinder as claimed in claim 3, comprising:

a connecting line provided between the damping chamber and a volume connected to the second pressure region;

a valve provided in the connecting line, opening a passage cross section depending on a supplied working pressure and a pressure in the damping chamber in order to limit the pressure in the damping chamber; and a control surface provided in order to open the valve in case of a positive pressure gradient between the volume connected to the second pressure region and a pressure in the damping chamber.

9. The differential cylinder as claimed in claim 1, comprising:

an adjusting element provided for jointly setting the passage cross sections of the restrictor units.

10. The differential cylinder as claimed in claim 9, comprising:

a pressure compensating line provided between the damping chamber and a volume connected to the second pressure region; and a valve provided in the pressure compensating line to allow only inflow of hydraulic fluid into the damping chamber.

11. The differential cylinder as claimed in claim 9, wherein the adjusting element has a plurality of passages formed therein, and wherein an overlap between each of the plurality of passages and one of the plurality of outlet lines sets the corresponding passage cross section.

12. The differential cylinder as claimed in claim 11, wherein the adjusting element is configured to adjust the passage cross sections of the restrictor units by rotating relative to the plurality of outlet lines.

13. The differential cylinder as claimed in claim 2, comprising:

a pressure compensating line provided between the damping chamber and a volume connected to the second pressure region; and a valve provided in the pressure compensating line to allow only inflow of hydraulic fluid into the damping chamber.

14. The differential cylinder as claimed in claim 2, comprising:

a connecting line provided between the damping chamber and a volume connected to the second pressure region;

a valve provided in the connecting line, opening a passage cross section depending on a supplied working pressure and a pressure in the damping chamber in order to limit the pressure in the damping chamber; and a control surface provided in order to open the valve in case of a positive pressure gradient between the volume connected to the second pressure region and a pressure in the damping chamber.

15. The differential cylinder as claimed in claim 1, wherein the plurality of outlet lines are arranged on a side wall of the damping chamber at axially mutually offset positions with respect to a direction of movement of the piston.

16. A hydromechanical drive for a high-voltage circuit breaker having a differential cylinder, comprising:

a first pressure region for supplying with a working pressure;

a second pressure region;

a piston, having a range of movement and which is movable depending on a pressure difference between the first and second pressure regions;

a damping chamber at an end of the second pressure region opposite from the piston, the damping chamber including a plurality of outlet lines, which are each closed or opened by a damping pin depending on a position of the damping pin in the damping chamber, the damping pin having a cross-section different than a cross-section of the piston; and a plurality of adjustable restrictor units, wherein the outlet lines are each connected to a respective adjustable restrictor unit for setting a passage cross section for a hydraulic fluid situated in the damping chamber and wherein each of the plurality of adjustable restrictor units is individually adjustable;

wherein in an event of a movement of the piston in a direction of the second pressure region, the plurality of adjustable restrictor units provide damping with respect to the movement of the piston in a section of the range of movement, wherein the damping is adjustable.

17. The hydromechanical drive as claimed in claim 16, wherein the plurality of outlet lines are arranged on a side wall of the damping chamber at axially mutually offset positions with respect to a direction of movement of the piston.

18. A differential cylinder for a hydromechanical drive for actuating an electrical switch, comprising:

a first pressure region for supplying with a working pressure;

a second pressure region;

a third pressure region;

a piston having a range of movement and which is movable depending on a pressure difference between the first and second pressure regions;

a damping pin projecting from the piston in the direction of the second pressure region;

a mobile damping piston, wherein a damping chamber is arranged in the mobile damping piston at an end of the second pressure region opposite from the piston, and wherein the mobile damping piston is movable in a direction of the third pressure region, such that the damping piston will move in the direction of the third pressure region depending on a pressure in the damping chamber, for limiting a pressure rise in the damping chamber;

a pressure compensating line provided between the damping chamber and a volume connected to the second pressure region; and a valve provided in the pressure compensating line to allow only inflow of hydraulic fluid into the damping chamber;

wherein in an event of a movement of the piston in a direction of the second pressure region, the damping chamber and the damping pin provide damping with respect to the movement of the piston in a section of the range of movement.

19. The differential cylinder as claimed in claim 18, wherein the damping pin and the damping chamber are arranged such that the damping pin projects into the damping chamber in a section of the range of movement for separating the second pressure region from the damping chamber.

20. The differential cylinder as claimed in claim 19, wherein the damping pin and the damping chamber are arranged such that, after penetration of the damping pin into the damping chamber, there remains a residual gap which has a predetermined passage cross section.

21. The differential cylinder as claimed in claim 20, wherein the predetermined passage cross section is arranged such that it brings about a predetermined maximum damping with respect to the movement of the piston.

* * * * *